US006940984B2

(12) United States Patent
Carpenter

(10) Patent No.: US 6,940,984 B2
(45) Date of Patent: Sep. 6, 2005

(54) HANDS-FREE MEGAPHONE

(76) Inventor: Robert Leonard Carpenter, 29 Wester-Moor Drive, Roundswell, Barnstaple, Devon, EX31 3XU (GB)

( * ) Notice: Subject to any disclaimer, the term of this patent is extended or adjusted under 35 U.S.C. 154(b) by 810 days.

(21) Appl. No.: 09/862,386

(22) Filed: May 22, 2001

(65) Prior Publication Data

US 2002/0176586 A1 Nov. 28, 2002

(51) Int. Cl.[7] ..... H04R 27/04
(52) U.S. Cl. ..... 381/75
(58) Field of Search ..... 381/75, 364, 367, 381/330, 362, 375, 370, 381, 376, 380, 382; 224/929, 930, 681; 455/569.1, 569.2

(56) References Cited

U.S. PATENT DOCUMENTS 5,353,975 A * 10/1994 Libertucci ..... 224/930
5,933,511 A * 8/1999 Garth, Sr. ..... 381/367
6,015,160 A * 1/2000 Spector ..... 381/75
6,490,362 B1 * 12/2002 Clegg et al. ..... 381/375

FOREIGN PATENT DOCUMENTS

GB 2349035 A * 10/2000 ..... H04R/27/04

* cited by examiner

*Primary Examiner*—Sinh Tran
*Assistant Examiner*—Brian Tyrone Pendleton
(74) *Attorney, Agent, or Firm*—Ira S. Dorman

(57) ABSTRACT

The megaphone includes a headset 1 incorporating a microphone 5 which is connected via a flexible cable 8 to a body pack 2. The body pack includes a housing 9 which incorporates a battery compartment, an amplifier, a siren and an on/off switch. The housing 9 is mounted on a belt 3 together with an audio output horn 12.

3 Claims, 3 Drawing Sheets

HANDS-FREE MEGAPHONE

TECHNICAL FIELD OF THE INVENTION

This invention relates to megaphones.

BACKGROUND

Traditional megaphones were in the form of a cone which was held to the mouth. The voice of the user was concentrated in one direction making it audible over a greater distance.

Later, with the advent of electronics, electronic megaphones became available. These are of similar physical shape to the original megaphones, being manually held to the users mouth when in use. A microphone at one end of the megaphone picks up the users voice which is then amplified electronically and used to drive a horn which reproduces the users voice at increased volume, throwing it in the desired direction. Electronic megaphones require batteries which add considerably to the weight of the megaphone, making them very tiresome to use. Also, at least one hand is always required to hold the megaphone, restricting the freedom of the user to carry out other tasks.

Various modifications have been devised. For example, a known kind of electronic megaphone incorporates a shoulder strap for carrying the main body of the megaphone whilst the microphone is connected to the main body via a curly lead. However, the concentration of weight on one shoulder still makes the megaphone uncomfortable to use for long periods, and at least one free hand is still required to hold the microphone.

Another shortcoming of many known megaphones is that they have a limited, though extended range. It is still difficult to make communication with anyone located near the limit of the range, especially under conditions of high ambient noise.

The present invention seeks to provide a new and inventive form of megaphone.

SUMMARY OF THE INVENTION

The present invention proposes a megaphone having:

- a microphone assembly including means for attachment to a user adjacent to the users mouth for hands-free operation;
- a body pack provided with means for attachment to the users body and incorporating an output horn; and
- a flexible cable connecting the microphone assembly to the body pack.

The microphone assembly preferably incorporates a resilient head band for mounting the assembly on the users head. The assembly can therefore be very lightweight. A volume control can be incorporated in the microphone assembly if desired, with little increase in weight.

The body pack preferably incorporates a battery compartment. Since the horn and batteries are generally the heaviest components of the megaphone the majority of the weight is carried on the body and the user's hands are left free. The body pack may conveniently incorporate an amplifier assembled on a small printed circuit board. The volume control may be incorporated in the body pack instead of the microphone assembly. In addition, it will generally be most convenient to incorporate an on/off switch in the body pack so that the number of conductors in the cable is minimised.

The body pack preferably includes a belt for securing the body pack about the waist of the user since this allows the weight to be distributed on the body in the most comfortable manner.

BRIEF DESCRIPTION OF THE DRAWINGS

The following description and the accompanying drawings referred to therein are included byway of non-limiting example in order to illustrate how the invention may be put into practice. In the drawings.

DETAILED DESCRIPTION OF THE DRAWINGS

Figure 1:
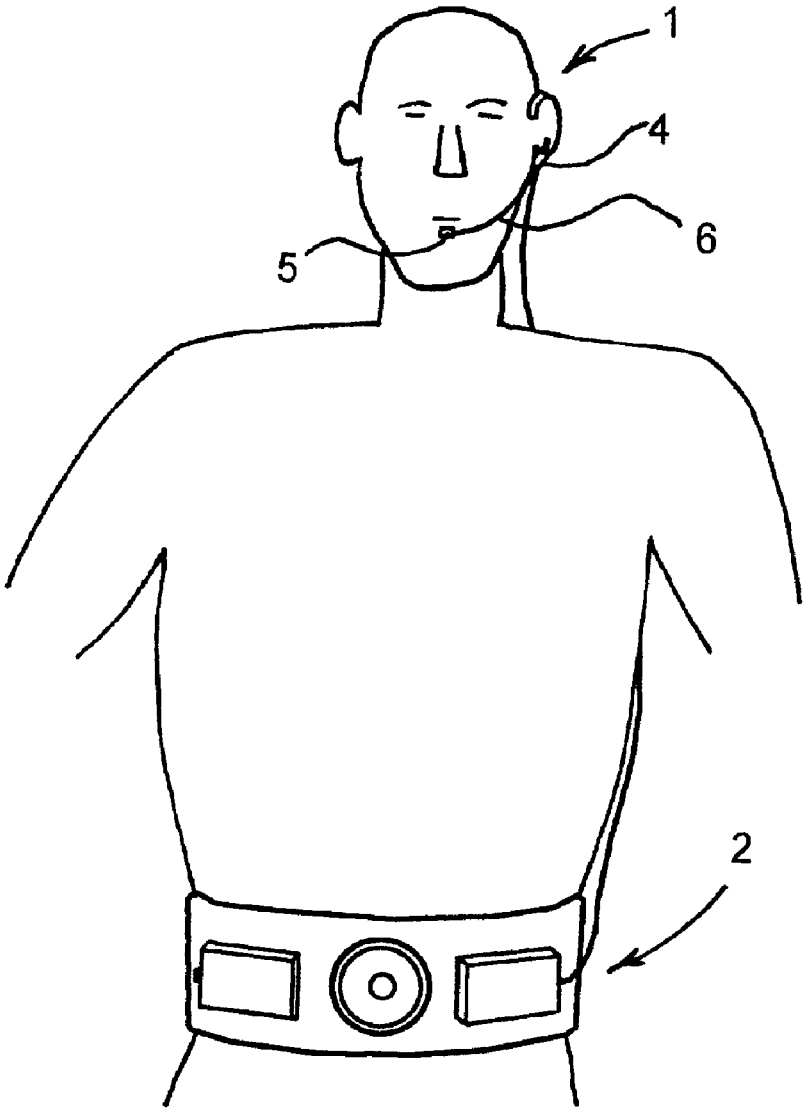
FIG. 1 is a front view of a person wearing a megaphone in accordance with the invention.

Referring firstly to FIG. 1, the megaphone comprises a hands-free headset 1 and a body pack 2 which is secured about the waist of the user.

Figure 2:
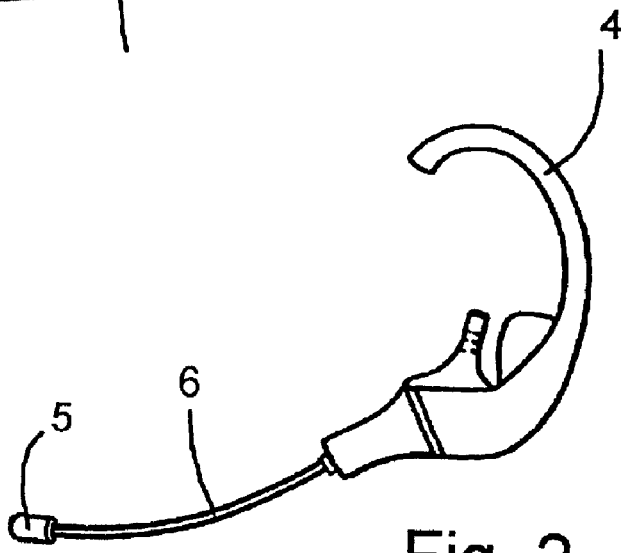
FIG. 2 is a detailed view of the headset shown in FIG. 1.

The headset 1 includes a lightweight member 4 and a microphone 5, weighing about 25 grams, which is secured to the member 4 by a non-resilient boom 6. The boom can be bent in order to position the microphone adjacent to the mouth of the wearer as shown. The headset 1 is shown in more detail in FIG. 2 in which it can be seen that the member 4 is a C-shaped plastics moulding which is shaped to hook around the ear of the user.

Figure 3:
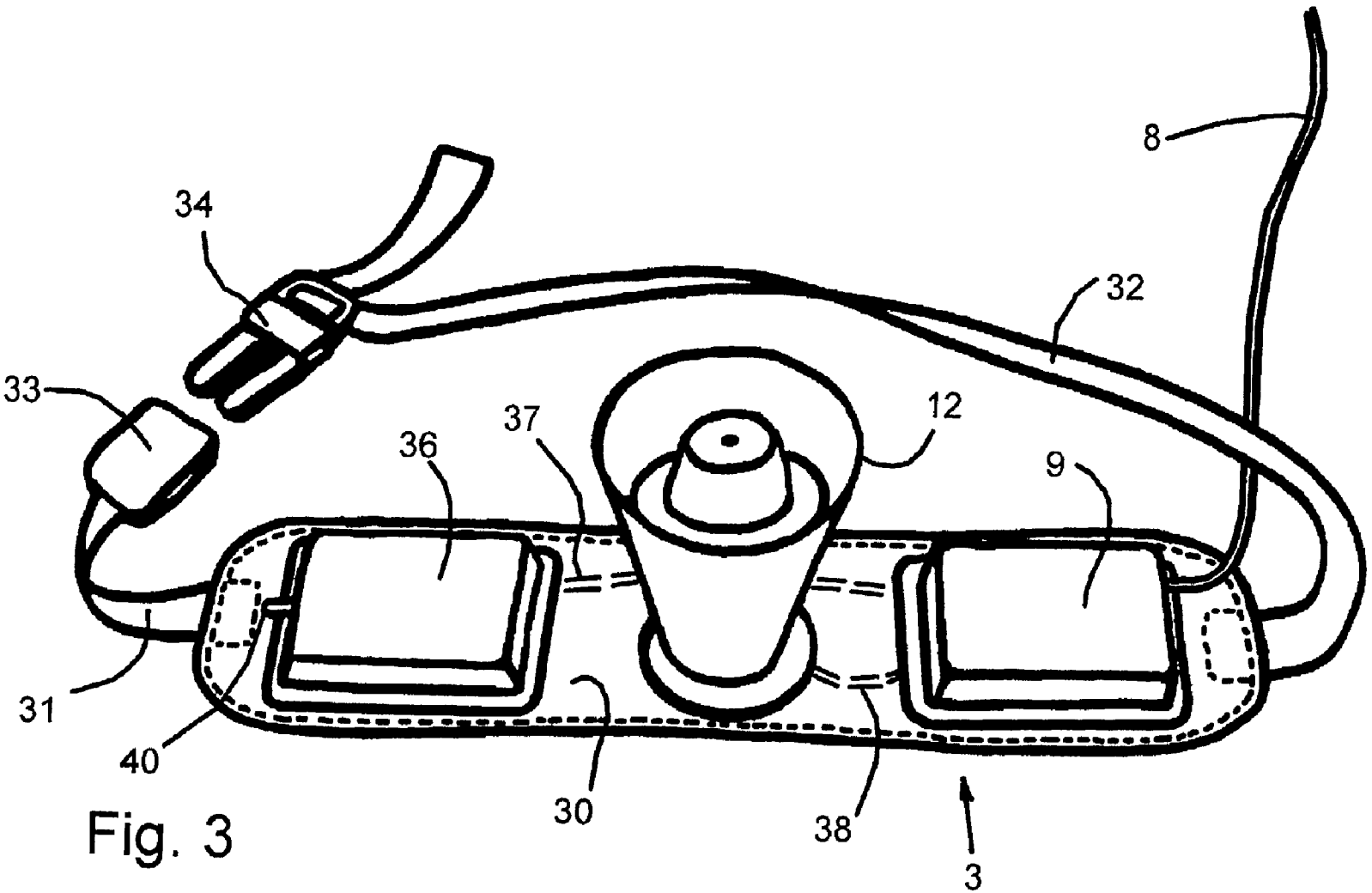
FIG. 3 is a detailed view of the body pack shown in FIG. 1.

The body pack 2, shown in more detail in FIG. 3, includes a belt 3 for securing the pack about the wearer. The belt includes an elongate rectangular front panel 30 formed of a pair of superimposed sheets of flexible material such as synthetic webbing secured together around their peripheries as by stitching. A pair of flexible straps 31 and 32 project from opposite ends of the panel 30. A releasable two-part moulded plastics connector 33, 34 is secured to the two straps, one of the connector parts 33 being non-adjustably secured to the strap 31 and the other part 34 being threaded onto the strap in a known pull-lock manner allowing its distance along the strap 32 to be adjusted. The two-connector parts 33 and 34 are snap-engageable and releasable using a squeezing action in known manner.

A rosette-type 90 mm diameter reflex horn 12 is mounted in the centre of the panel 30 to emit sounds in a forward direction. The horn is mounted between a battery compartment 36 and a housing 9. The battery compartment 36 holds eight "AA" cells which provide a total potential of 12 volts to power an electronic circuit in the housing 9. An on/off switch 40 is mounted on the battery compartment 36 to control the supply of power to the housing 9 through a pair of electrical conductors 37 which are incorporated in the panel 30. A further pair of electrical conductors 38 are incorporated into the panel 30 to carry audio output signals from the housing 9 to the horn 12.

A 900 mm long flexible curly lead or cable 8 connects the headset 1 to the housing 9. The lead is releasably connected with the housing by means of a plug and socket. The housing 9 may also include a volume control (not shown). On the other hand, with some kinds of microphone (e.g. electret) the volume control can directly adjust the output of the microphone and can be incorporated into the headset 1.

Figure 4:
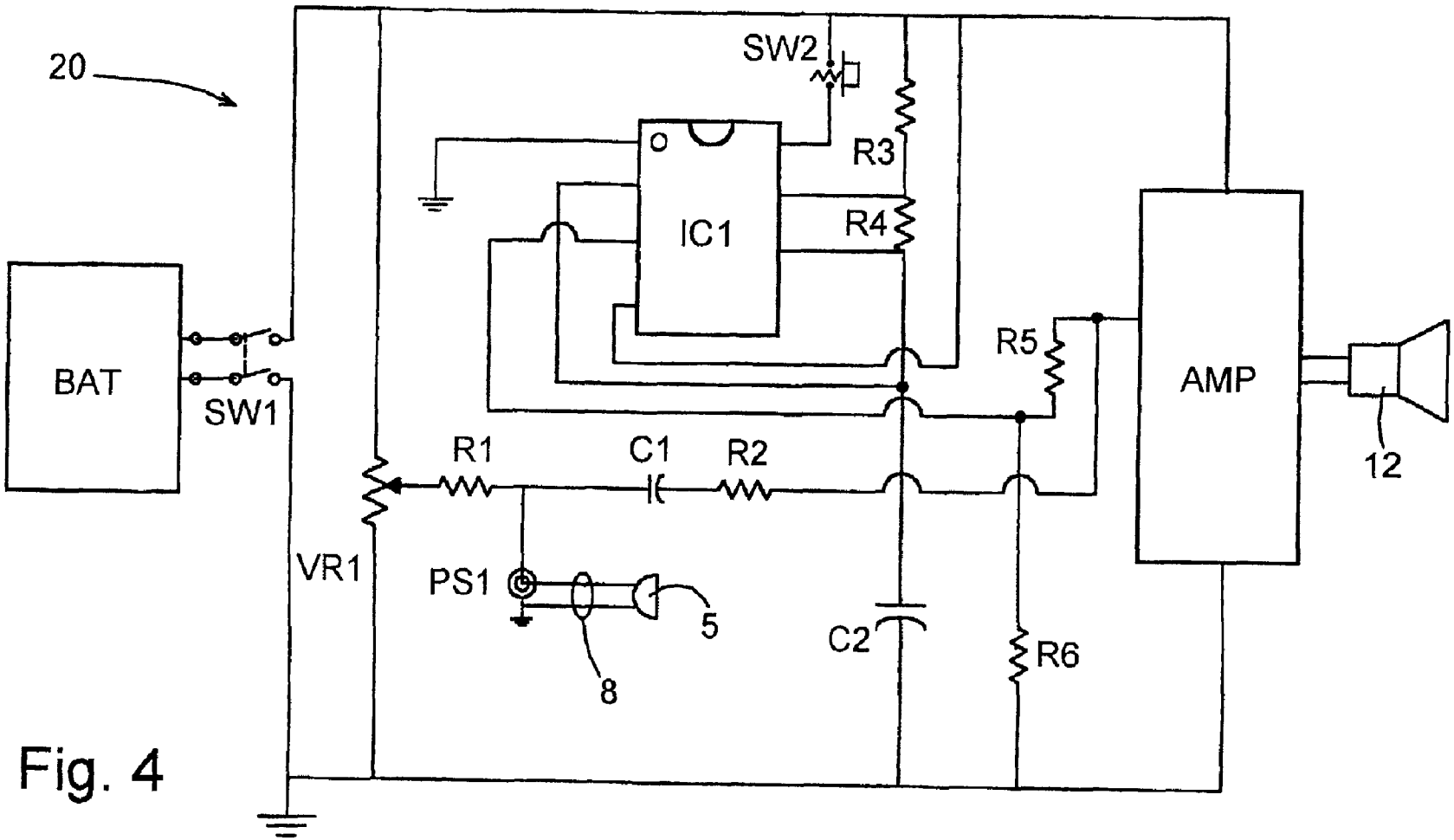
FIG. 4 is a circuit diagram of the electronic parts of the megaphone.

FIG. 4 shows the electronic circuit 20 which is contained in the housing 9 in more detail. Power from the battery pack BAT is supplied through a double pole single throw on/off switch SW1. Potentiometer VR1 sets the dc bias which is applied to the electret microphone 5 via resistor R1 to about 1.5 volts. The microphone has an response frequency range of about 20 Hz to 16 kHz to pick up the users voice and generate low level voice signals which travel to the circuit via flexible cable 8 and plug-and-socket PS1. After passing through dc blocking capacitor C1 and resistor R2 the signals reach the input of an audio amplifier AMP, typically provided by a single integrated circuit having an input sensitivity of 40 mV into 150 k ohms, a signal-to-noise ratio of 86 db and a frequency response of 20 Hz to 16 kHz. After amplification the high level output signals, up to 7 watts, are sent to the horn 12 which typically has an impedance of about 8 ohms and a frequency response of 800 Hz to 7 kHz with an output capability of about 10 watts. The horn thus reproduces the users voice at greatly increased volume.

The circuit also includes an audio frequency fixed tone oscillator based on a timer chip IC1, e.g. type NE555. The frequency of oscillation is determined by the feedback network comprising resistors R3 and R4 and capacitor C2. The oscillator output is set to a level which avoids overloading the amplifier AMP by means of the potential divider R5 and R6. The oscillator only operates when a spring-loaded press switch SW2 is depressed to supply power to the chip IC1, which thus causes a fixed audio output tone of about 1500 Hz to pass through the amplifier and emit a loud tone from the horn 12, overpowering any voice input from the microphone 5. This siren mode can be used to attract the attention of people a considerable distance from the user prior to communicating with them using the voice amplification mode.

Since people generally face towards someone they are communicating with, even at a distance, the horn is always facing in the required direction. The megaphone is very comfortable to wear for long or short periods and furthermore, after switching on the megaphone and adjusting the volume the wearers hands are left completely free. The maximum operating range is generally in the range of 0.5 to 0.7 km depending on operating conditions.

The megaphone is suitable for use by sporting coaches (e.g. soccer, rugby, cricket or rowing coaches) teachers, rescuers and many others who need to use a megaphone for long periods.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. A megaphone having:

a headset including a microphone assembly, said microphone assembly including a microphone, a curved member for attaching the microphone assembly to the head of a user, and a stalk connecting the microphone to the curved member and being capable of being bent to position the microphone adjacent to the user's mouth for hands-free operation;

a body pack incorporating a belt for securing the body pack about the waist of the user, the belt including an elongate flexible panel having opposite ends;

an output horn which is mounted proximate the centre of the panel to be forwardly-directed in use, a battery pack mounted on said panel, separately from said output horn, between the output horn and one of said ends, and an electronic module mounted on said panel, separately from said output horn, between the output horn and the other of said ends, which is powered by the battery pack through electrical conductors incorporated in said panel, and provides an audio frequency amplifier having a low signal level input and a high signal level output arranged to supply audio frequency power to the output horn through further electrical conductors incorporated in said panel; and a flexible cable connecting the microphone assembly to the body pack.

2. A megaphone which includes:

a headset incorporating a microphone assembly, said microphone assembly including a microphone for receiving voice signals from a user, a curved member for attaching the microphone assembly to the user, and a stalk connecting the microphone to the curved member and being capable of being bent to position the microphone adjacent to the user's mouth for hands-free operation;

a body pack incorporating a belt for securing the body pack about the waist of the user, the belt including an elongate flexible panel having opposite ends, an output horn which is mounted on the belt proximate the centre of the panel to be forwardly-directed in use, a battery pack mounted on said panel, separately from said output horn, between the output horn and one of said ends, an electronic module mounted on said panel, separately from said output horn, between the output horn and the other of said end, which is powered by the battery pack through electrical conductors incorporated in said panel and provides an audio frequency amplifier having a low signal level input and a high signal level output arranged to supply audio frequency power to the output horn through further electrical conductors incorporated in said panel, and a high frequency audio tone generator connected to the low signal level input of the audio frequency amplifier, and manually operable means for controlling the tone generator to output an audio tone of substantially constant frequency to the input at an amplitude which overrides any voice signals from the microphone; and a flexible cable connecting the headset to the body pack to conduct audio signals from the microphone to the input of the audio frequency amplifier such that, when the manually operable means is not being operated to output an audio frequency tone to the input of the amplifier the amplifier acts to amplify voice signals from the microphone.

3. A megaphone which includes:

a headset incorporating a microphone assembly, said microphone assembly including a microphone for receiving voice signals from a user, a curved ear hook member which is pre-formed to locate about the ear of the user, and a stalk connecting the microphone to the curved member and being capable of being bent to position the microphone adjacent to the user's mouth for hands-free operation;

a body pack incorporating a belt for securing the body pack about the waist of the user, the belt including an elongate flexible panel having opposite ends, a pair of straps secured to opposite ends of said panel, and a pair of moulded snap-fit connector parts secured to the two straps;

an output horn which is mounted proximate the centre of the panel to be forwardly-directed in use, a battery pack mounted on said panel, separately from said output horn, between the output horn and one of said ends, and an electronic module mounted on said panel, separately from said output horn, between the output horn and the other of said ends, which is powered by the battery pack through electrical conductors incorporated in said panel, and provides an audio frequency amplifier having a low signal level input and a high signal level output arranged to supply audio frequency power to the output horn through further electrical conductors incorporated in said panel; and a flexible cable connecting the headset to the body pack to conduct audio signals from the microphone to the input of the audio frequency amplifier such that the amplifier acts to amplify voice signals from the microphone.

* * * * *